US008344604B2

(12) United States Patent
Torii et al.

(10) Patent No.: US 8,344,604 B2
(45) Date of Patent: Jan. 1, 2013

(54) SPARK PLUG FOR INTERNAL COMBUSTION ENGINE

(75) Inventors: Kazuyoshi Torii, Aichi (JP); Naomichi Miyashita, Kasugai (JP); Mamoru Musasa, Nagoya (JP); Akira Suzuki, Nagoya (JP); Tomoo Tanaka, Kitanagoya (JP); Osamu Yoshimoto, Inazawa (JP)

(73) Assignee: NGK Spark Plug Co., Ltd., Aichi (JP)

( * ) Notice: Subject to any disclaimer, the term of this patent is extended or adjusted under 35 U.S.C. 154(b) by 419 days.

(21) Appl. No.: 12/743,092

(22) PCT Filed: Nov. 13, 2008

(86) PCT No.: PCT/JP2008/070656

§ 371 (c)(1),
(2), (4) Date: May 14, 2010

(87) PCT Pub. No.: WO2009/063930

PCT Pub. Date: May 22, 2009

(65) Prior Publication Data

US 2010/0242888 A1 Sep. 30, 2010

(30) Foreign Application Priority Data

Nov. 15, 2007 (JP) ..... 2007-296453

(51) Int. Cl.
*H01T 13/20* (2006.01)
*H01T 21/02* (2006.01)

(52) U.S. Cl. ..... 313/141; 313/143; 313/144

(58) Field of Classification Search ..... 123/169 E, 123/169 EL; 315/71; 313/118 T, 118, 142, 313/145

See application file for complete search history.

(56) References Cited

U.S. PATENT DOCUMENTS 4,540,910 A * 9/1985 Kondo et al. ..... 313/11.5
4,581,558 A * 4/1986 Takamura et al. ..... 313/141

(Continued)

FOREIGN PATENT DOCUMENTS

JP 62-045137 A 2/1987

(Continued)

OTHER PUBLICATIONS

Written Opinion [PCT/ISA/237] issued Feb. 24, 2009, in PCT/JP2008/070656.

*Primary Examiner* — Sam Yao
*Assistant Examiner* — Craig O'Connor
(74) *Attorney, Agent, or Firm* — Sughrue Mion, PLLC

(57) ABSTRACT

A precious metal tip on the side of a ground electrode is indirectly joined to the front end portion of the ground electrode via a mounting part interposed therebetween. The mounting part includes a base part and a protruding part. First, in the state where the precious metal tip is in contact with the protruding part, laser welding or the like is performed thereon to form a fused part and obtain a complex, and the base part is joined to a flat surface of the ground electrode by resistance welding. The grain size of grains of the mounting part in the vicinity of the of the fused part is greater than the grain size of the grain size of the grains thereof in the vicinity of the ground electrode, and the grain size of the grains of the flange part of the mounting part is smaller than the grain size of the grains of the protruding part.

11 Claims, 7 Drawing Sheets

U.S. PATENT DOCUMENTS 4,670,684 A * 6/1987 Kagawa et al. ..... 313/141
4,853,582 A * 8/1989 Sato et al. ..... 313/141
RE35,012 E * 8/1995 Takamura et al. ..... 313/141
5,465,022 A * 11/1995 Katoh et al. ..... 313/144
5,488,262 A * 1/1996 Takamura et al. ..... 313/141
6,346,766 B1 * 2/2002 Kanao et al. ..... 313/141
6,603,244 B2 * 8/2003 Sugiyama et al. ..... 313/118
6,621,198 B2 * 9/2003 Kanao et al. ..... 313/141
6,923,699 B2 * 8/2005 Matsubara et al. ..... 445/7
7,084,558 B2 8/2006 Teramura et al.
7,132,782 B2 11/2006 Kato et al.
7,321,187 B2 1/2008 Teramura et al.
7,382,085 B2 * 6/2008 Suzuki ..... 313/141
7,521,850 B2 * 4/2009 Lykowski ..... 313/144
7,573,185 B2 * 8/2009 Lykowski ..... 313/141
7,581,304 B2 * 9/2009 Lykowski ..... 29/592.1
7,615,915 B2 * 11/2009 Ito et al. ..... 313/141
7,671,521 B2 * 3/2010 Lykowski ..... 313/141
7,948,159 B2 * 5/2011 Lykowski ..... 313/141
8,044,562 B2 * 10/2011 Musasa et al. ..... 313/141
8,052,495 B2 * 11/2011 Kato et al. ..... 445/7
8,098,004 B2 * 1/2012 Kato et al. ..... 313/141

FOREIGN PATENT DOCUMENTS

JP 3-166731 A 7/1991
JP 5-343159 A 12/1993
JP 8-037082 A 2/1996
JP 8-298178 A 11/1996
JP 2002-083663 A 3/2002
JP 2003-197346 A 7/2003
JP 2004-127916 A 4/2004
JP 2004-134209 A 4/2004
JP 2007-044699 A 2/2007

* cited by examiner

SPARK PLUG FOR INTERNAL COMBUSTION ENGINE

TECHNICAL FIELD

The present invention relates to a spark plug used for an internal combustion engine.

BACKGROUND ART

A spark plug for an internal combustion engine such as a vehicle engine includes, for example, a center electrode, an insulator provided on the outside thereof, a cylindrical metal shell provided on the outside of the insulator, and a ground electrode of which a base end portion is joined to the front end surface of the metal shell. The inner surface of the front end portion of the ground electrode is disposed to oppose the front end portion of the center electrode, and accordingly, a spark discharge gap is formed between the front end portion of the center electrode and the front end portion of the ground electrode.

Recently, it is considered that tips (precious metal tips) made of precious metal alloys can be joined to the front end portions of the center electrode and the ground electrode to achieve an improvement in spark consumption resistance in addition to an improvement in ignition performance and spark transmission. Further, there is a technique in which in order to achieve an increase in the joining strength between a precious metal tip and a ground electrode, the precious metal tip for the ground electrode is joined to an intermediate member, and the intermediate member is joined to the ground electrode (for example, refer to Patent Documents 1 and 2). In the technique, the intermediate member and the precious metal tip are joined with a fused part formed of the metal of the two fused together.

[Patent Document 1] JP-A-2004-134209

[Patent Document 2] JP-A-8-298178

DISCLOSURE OF THE INVENTION

Problem that the Invention is to Solve

Incidentally, with the current demand for reduction in spark plug diameter, there is a need for thinning the ground electrode. Even in consideration of the combustion condition of an engine, due to the lean burning and high compression of fuel, the ground electrode is exposed to higher temperatures than ever.

In particular, in the technique for providing the intermediate member as in Patent Document described above, the intermediate member is disposed to protrude further (at an interval from the ground electrode having relatively excellent heat transfer) than the ground electrode, and it can be said that it is more likely to be exposed to high temperatures. Accordingly, oxidization (corrosion) occurs at the interface between the fused part and the intermediate member, and there is a concern that an oxide film (oxide scale) will be formed. More specifically, when oxygen intrudes into the interface between the fused part and the intermediate member, material that is more likely to oxidize moves to the interface from the inside of the intermediate member and is combined with oxygen, so that an oxide film is easily formed at the interface. Further, when an oxide film is formed at the interface between the fused part and the intermediate member, the joining strength at the interface significantly decreases, and as a result, there is a concern that this will cause degradation in the exfoliation resistance of the precious metal tip.

In order to solve the above-mentioned problems, it is an object of the invention to provide a spark plug for an internal combustion engine, which is a spark plug having a precious metal tip joined to the front end portion of a ground electrode and which guarantees the stable junction state of the precious metal tip for a long time.

Means for Carrying Out the Invention

Hereinafter, aspects suitable for solving the problem will be described in different paragraphs. In addition, as needed, the corresponding operations and effects of the aspects will be additionally described.

In a first aspect, a spark plug for an internal combustion engine comprises:

a center electrode which has a bar shape extending in the direction of an axis;

an insulator which has a substantially cylindrical shape and is provided on the outer periphery of the center electrode;

a tubular metal shell which is provided on the outer periphery of the insulator; and a ground electrode which has a base end portion joined to the metal shell and a front end portion disposed to face a front end portion of the center electrode, wherein a ground electrode precious metal tip is joined to the front end portion of the ground electrode at a position opposed to the front end portion of the center electrode or a center electrode precious metal tip joined to the front end of the center electrode, wherein a spark discharge gap is formed between the front end portion of the center electrode or the front end portion of the center electrode precious metal tip, and the front end portion of the ground electrode precious metal tip, wherein the ground electrode precious metal tip is joined to a bearing surface of a mounting part containing the same component as the ground electrode with a fused part formed by performing laser welding or electron beam welding on the metal of the two to be fused together, wherein the mounting part is joined to the ground electrode, and wherein grain size of the grains of the mounting part in the vicinity of the fused part is greater than the grain size of the grains thereof in the vicinity of the ground electrode.

With the first aspect, the precious metal tip for the ground electrode is joined to the bearing surface of the mounting part with a fused part formed of the metal of the two fused together by laser welding or electron beam welding. Accordingly, it is possible to guarantee sufficient joining strength between the mounting part and the precious metal tip for the ground electrode. Further, the mounting part contains the same component as the ground electrode and can guarantee relatively sufficient joining strength even in the case where it is joined to the ground electrode by, for example, resistance welding.

Incidentally, the mounting part protrudes from the ground electrode and is more likely to be exposed to high temperatures. Moreover, as described above, there is a concern that an oxide film will be formed by a combination of material that is more likely to oxidize and oxygen at the interface between the fused part and the mounting part. In this aspect, in the first aspect, the grain size of the grains of the mounting part in the vicinity of the fused part is greater than the grain size of the grains thereof in the vicinity of the ground electrode. Accordingly, in the mounting part in the vicinity of the fused part, the number of pathways on which material that is more likely to oxidize can move is relatively small. Therefore, even when oxygen intrudes into the interface, the material that is more likely to oxidize hardly appears at the interface from the inside of the mounting part, so that formation of an oxide film rarely occurs. As a result, the stable joining strength at the interface can be guaranteed for a long time, thereby preventing degradation in the exfoliation resistance of the precious metal tip for the ground electrode.

Here, the "grain size of grains" refers to the average grain size of grains in a predetermined region. As a calculation method, for example, a picture of a cross-section passing through the axis center of the precious metal tip for the ground electrode is acquired, a virtual circle with a diameter of 0.1 mm is drawn on the picture, and the number of grains included in the virtual circle is measured. By dividing the area of the virtual circle by the number of grains, a sectional area per grain is calculated, and the diameter of the grain is calculated from the area. The value obtained through the calculation is the grain size of the grains. "The vicinity of the fused part" is generally any region in which the distance to the fused part is shorter than the distance to the ground electrode. For example, when a virtual circle with a diameter of 0.1 mm is to be drawn, a part of the virtual circle is drawn to overlap with the "fused part", and grains included in the circle are used for measuring the grain size. Likewise, "the vicinity of the ground electrode" is generally any region in which the distance to the ground electrode is shorter than the distance to the fused part. For example, when a virtual circle with a diameter of 0.1 mm is to be drawn, a part of the virtual circle is drawn to overlap with the ground electrode, and grains included in the circle are used for measuring the grain size.

Further, it is preferable that "the precious metal tip for the ground electrode is joined to the bearing surface of the mounting part to form a complex and the mounting part of the complex is joined to the ground electrode". Accordingly, the joining process can be performed smoothly.

Further, it is further preferable that the second, third, fourth, fifth, sixth, and seventh aspects described as follows be employed.

In the second aspect: in the spark plug in the first aspect, the mounting part includes:

a disc shape base part having one end surface which is joined to the ground electrode; and a protruding part which protrudes from the other end surface of the base part and has a columnar shape with a smaller diameter than that of the base part, and to which the ground electrode precious metal tip is joined, a part of the base part which protrudes in the outer peripheral direction from the protruding part is a flange part, and the grain size of the grains of the flange part is smaller than the grain size of the grains of the protruding part.

With the second aspect, since the mounting part has the base part provided with the flange part on the outer periphery, on the side joined to the ground electrode, an increased joining area can be achieved as compared with the case of no flange part. Accordingly, it is possible to achieve a stronger junction. Since the heat transfer path of the precious metal tip for the ground electrode is widened, it is possible to achieve an improvement in the durability of the precious metal tip.

In the meantime, since the mounting part is provided with the flange part and the flange part protrudes from the ground electrode, there is concern about spark consumption clue to a spark discharge toward the flange part. Particularly, there is a possibility that the grains of the flange part of the mounting part will become separated at grain boundary due to the impact of the spark discharge, and when the grains are large, the degree of consumption due to the separation increases. In this aspect, in the second aspect, in the mounting part, the grain size of the grains of the flange part is smaller than the grain size of the grains of the protruding part. Accordingly, even when a spark discharge occurs between the center electrode (or the precious metal tip of the center electrode), and the flange part, the grain separation is relatively small, so that damage due to the separation can be minimized. As a result, it is possible to prevent spark consumption resistance degradation in the mounting part.

In a third aspect, a spark plug for an internal combustion engine comprises:

a center electrode which has a bar shape extending in the direction of an axis;

an insulator which has a substantially cylindrical shape and is provided on the outer periphery of the center electrode;

a tubular metal shell which is provided on the outer periphery of the insulator; and a ground electrode which has a base end portion joined to the metal shell and a front end portion disposed to face a front end portion of the center electrode, wherein a ground electrode precious metal tip is joined to the front end portion of the ground electrode at a position opposed to the front end portion of the center electrode or a center electrode precious metal tip joined to the front end of the center electrode, wherein a spark discharge gap is formed between the front end portion of the center electrode or the front end portion of the center electrode precious metal tip, and the front end portion of the ground electrode precious metal tip, wherein the ground electrode precious metal tip is joined to a bearing surface of a mounting part containing the same component as the ground electrode with a fused part formed by performing laser welding or electron beam welding on the metal of the two to be fused together, wherein the mounting part is joined to the ground electrode, wherein the mounting part includes:

a disc shape base part having one end surface which is joined to the ground electrode;

a protruding part which protrudes from the other end surface of the base part and has a columnar shape with a smaller diameter than that of the base part, and to which the ground electrode precious metal tip is joined; and a part of the base part which protrudes in the outer peripheral direction from the protruding part is a flange part, and wherein grain size of the grains of the flange part is smaller than the grain size of the grains of the protruding part.

With the third aspect, the effects of first and second aspects are exhibited.

In a fourth aspect, in the spark plug in the second or third aspect, $A>10$, and $B\leqq 10$ are satisfied, where A (μm) represents the grain size of the grains of the protruding part and B (μm) represents the grain size of the grains of the flange part.

In a fifth aspect, in the spark plug in the fourth aspect, $10A\leqq 200$, and $0.1\leqq B\leqq 10$ are satisfied.

In order for the above-mentioned effects to be reliably exhibited, as in the fourth aspect, it is preferable that the grain size A of the grains of the protruding part be greater than 10 μm. Accordingly, a significant improvement in oxidation resistance can be achieved, so that it is possible to prevent the degradation in the exfoliation resistance of the precious metal tip for the ground electrode. It is preferable that the grain size B of the grains of the flange part be equal to or smaller than 10 μm. Accordingly, it is possible to prevent an increase in the degree of the flange part consumption caused by a separation of the relatively larger grains.

Particularly, as in the fifth aspect, it is preferable that the grain size A of the grains of the protruding part be smaller than 200 μm. In the case where the grain size A is equal to or greater than 200 μm, there is a concern that the precious metal tip for the ground electrode will separate as the grains are separated. It is preferable that the grain size B of the grains of the flange part be equal to or greater than 0.1 μm. In the case where the grain size B is smaller than 0.1 μm, the hardness of the flange part increases, and there is concern about degradation in processability.

In a sixth aspect, in the spark plug in the second to fifth aspects, the grains of the flange part are flat and oriented in a direction perpendicular to the direction of the axis of the mounting part.

With the sixth aspect, since the grains of the flange part are flat and oriented in the direction perpendicular to the direction of the axis of the mounting part, although a spark discharge occurs between the center electrode (or the precious metal tip of the center electrode) and the flange part and the grains are separated, it is possible to minimize recesses and cracks formed in the direction of the axis (the thickness direction). As a result, it is possible to further prevent spark consumption resistance degradation in the mounting part.

In a seventh aspect, in the spark plug in the second to fifth aspects, the mounting part mainly contains metal that is the same as the main component of the ground electrode.

With the seventh aspect, the main component of the mounting part is metal (for example, nickel) which is the same as the main component of the ground electrode. Accordingly, the compatibility of the mounting part and the ground electrode is increased, and for example, in the case where the two are fused together by resistance welding or the like, it is possible to significantly enhance the joining strength.

BEST MODE FOR CARRYING OUT THE INVENTION

Hereinafter, an embodiment will be described with reference to the accompanying drawings. FIG. 1 is a partially cutaway front view illustrating a spark plug 1. In FIG. 1, the direction of the axis CL1 of the spark plug 1 represents an up and down direction in the figure, and the lower side and the upper side represent the front end side and the rear end side of the spark plug 1.

The spark plug 1 includes an insulator 2 which is a long insulating member, and a cylindrical metal shell 3 for holding this.

The insulator 2 is provided with an axial hole 4 penetrating along the axis CL1. A center electrode 5 is inserted into and fixed to the front end portion of the axial hole 4, and a terminal electrode 6 is inserted into and fixed to the rear end portion. In the axial hole 4, a resistor 7 is disposed between the center electrode 5 and the terminal electrode 6, and both end portions of the resistor 7 are electrically connected to the center electrode 5 and the terminal electrode 6 via conductive glass sealing layers 8 and 9, respectively.

The center electrode 5 protrudes from the front end of the insulator 2 to be fixed thereto, and the terminal electrode 6 protrudes from the rear end of the insulator 2 to be fixed thereto. In addition, a precious metal tip (a precious metal tip for the center electrode) 31 containing iridium as a main component and 5 mass % of platinum is joined to the center electrode 5 by welding.

On the other hand, the insulator 2 is, as is well known, formed by performing firing on aluminum and the like, and includes, from the outer appearance, a large diameter part 11 having the shape of a flange protruding outward in the radial direction substantially at the center portion of the direction of the axis CL1, an intermediate shank part 12 provided on the front end side in front of the large diameter part 11 with a smaller diameter, and a long leg part 13 provided on the front end side in front of the intermediate shank part 12 with a smaller diameter and exposed to the combustion chamber of an internal combustion engine (engine). The front end side of insulator 2, which includes the large diameter part 11, the intermediate shank part 12, and the long leg part 13, is accommodated in the cylindrical metal shell 3. A step part 14 is formed at a connection portion between the long leg part 13 and the intermediate shank part 12, and the insulator 2 is locked to the metal shell 3 with the step part 14.

The metal shell 3 is formed of metal such as low carbon steel into a cylindrical shape, and on the outer peripheral surface, a screw part (thread) 15 needed for mounting the spark plug 1 to a cylinder head of the engine is formed. A seating part 16 is provided on the outer peripheral surface on the rear end side behind the screw part 15, a ring-shaped gasket 18 is insert-fitted to a screw head 17 on the rear end of the screw part 15. On the rear end side of the metal shell 3, a tool engagement part 19 which has a hexagonal cross-section and to which a tool such as a wrench is engaged to mount the metal shell 3 to the cylinder head is provided, and at the rear end portion thereof, a swage part 20 for holding the insulator 2 is provided.

A step part 21 for locking the insulator 2 is provided on the inner peripheral surface of the metal shell 3. In addition, the insulator 2 is inserted from the rear end side toward the front end side of the main metal clasp 3, and fixed by swaging an opening portion of the rear end side of the metal shell 3, that is, by forming the swage part 20 in the stage where its step part 14 is locked to the step part 21 of the metal shell 3. An annular-shaped plate packing 22 is interposed between the step parts 14 and 21 of the insulator 2 and the metal shell 3. Accordingly, the airtightness of the combustion chamber can be maintained, and the fuel gas flowing into a gap between the long leg part 13 of the insulator 2 exposed in the combustion chamber and the inner peripheral surface of the metal shell 3 does not leak.

In addition, for more complete airtightness by swaging, annular-shaped ring members 23 and 24 are interposed between the metal shell 3 and the insulator 2 on the rear end side of the metal shell 3, a powder of talc (talcum) 25 is filled between the ring members 23 and 24. That is, the metal shell 3 holds the insulator 2 with the plate packing 22, the ring members 23 and 24, and the talc 25 interposed therebetween.

In addition, a ground electrode 27 having a substantially L shape is joined to a front end surface 26 of the metal shell 3. That is, a base end portion of the ground electrode 27 is welded to the front end surface 26 of the metal shell 3, and a front end side thereof is bent such that a side surface of the front end side thereof faces a front end portion (a front end portion of the precious metal tip 31) of the center electrode 5. The ground electrode 27 is provided with a precious metal tip (a precious metal tip for the ground electrode) 32 which faces the precious metal tip 31. In addition, the precious metal tips 31 and 32 are aligned with the axis CL1 and the gap between the precious metal tips 31 and 32 is a spark discharge gap 33.

As illustrated in FIG. 2, the center electrode 5 is configured by an inner layer 5A made of copper or a copper alloy and an outer layer 5B made of a nickel (Ni) alloy. The center electrode 5 has a front end side with a small diameter, a bar shape (a column shape) in an overall view, and a flat front end surface. The precious metal tip 31 having a column shape is disposed to overlap therewith, and by performing laser welding, electron beam welding, or the like along the outer peripheral portion of the joining surface thereof; the precious metal tip 31 and the center electrode 5 are fused together into a fused part 41. That is, the precious metal tip 31 is fixed and joined to the center electrode 5 with the fused part 41.

In the meantime, the ground electrode 27 has a double-layer structure including an inner layer 27A and an outer layer 27B. In this embodiment, the outer layer 27B is made of a nickel alloy such as Inconel 600 or Inconel 601 (both are brand names). On the other hand, the inner layer 27A is made of a copper alloy that is a metal having better thermal conductivity than the nickel alloy or pure copper. Due to the existence of the inner layer 27A, it is possible to achieve an improvement in heat transfer. In this embodiment, for the convenience of description, the simple two-layer structure is described, however, a three-layer structure or a multi-layer structure having four or more layers may be employed. Here, it is preferable that the layer inside the outer layer 27B contain metal having better thermal conductivity that the outer layer 27B. Therefore, for example, an intermediate layer made of an alloy or pure copper may be provided inside the outer layer 27B, and an innermost layer made of pure nickel may be provided inside the intermediate layer. In this case, the intermediate layer and the innermost layer constitute the inner layer 27A. Of course, instead of a multi-layer structure, the ground electrode 27 may employ a single-layer structure made of only a nickel alloy.

It has been mentioned that the precious metal tip 31 of the center electrode 5 mainly contains iridium, and the precious metal tip 32 of the ground electrode 27 is made of a precious metal alloy containing, for example, platinum as a main component and 20 mass % of rhodium. Here, the composition thereof is only an example and not limited to the description. For example, as an another example, a precious metal alloy (Pt-10Ni) containing platinum as a main component and 10 mass % of nickel may be employed to enhance welds with a mounting part 51 described later which mainly contains nickel. The precious metal tips 31 and 32 are manufactured, for example, as follows. First, an ingot mainly containing iridium or platinum is prepared, alloy components are mixed and melted therewith to obtain the predetermined composition described above, an ingot related to the molten alloy is formed again, and thereafter, hot forging and hot rolling (groove rolling) are performed on the ingot. Thereafter, a bar-shaped material is obtained by drawing, and it is cut into predetermined lengths, thereby obtaining the columnar-shaped precious metal tips 31 and 32.

However, the precious metal tip 32 on the side of the ground electrode 27 in this embodiment is not directly joined to the front end portion of the ground electrode but indirectly joined thereto with the mounting part 51 mainly containing nickel as illustrated in FIG. 3. More specifically, the mounting part 51 includes a base part 53 having a disc shape, and a protruding part 54 which protrudes from the base part 53 and has a columnar shape with a diameter smaller than that of the base part 53. A part of the base part 53 which protrudes in the outer peripheral direction from the protruding part 54 is a flange part 52. The precious metal tip 32 is joined to a bearing surface 54*a* of the protruding part 54, and the base part 53 is joined to an inner flat surface of the ground electrode 27.

The joining order of the precious metal tip 32 and the mounting part 51 is described. First, as illustrated in FIG. 4A, in the state where the precious metal tip 32 is in contact with the bearing surface 54*a* of the protruding part 54 of the mounting part 51, laser welding or electron beam welding is performed thereon along the outer periphery of the joining surface thereof, as illustrated in FIG. 4B. Accordingly, the precious metal tip 32 and the mounting part 51 (the protruding part 54) are fused together to form a fused part 42, thereby obtaining a complex 71 in which the precious metal tip 32 and the mounting part 51 are fused and strongly fixed together with the fused part 42 interposed therebetween. As illustrated in FIG. 4C, (the base part 53 of) the mounting part 51 of the complex 71 is joined to the flat surface of the ground electrode 27 by resistance welding. Here, since both the mounting part 51 and the outer layer 27B of the ground electrode 27 are made of nickel alloys, sufficient joining strength can be obtained using resistance welding. Since welding is performed while the flange part 52 is suppressed during resistance welding, in this case, the peripheral portion (the flange part 52) of the base part 53 tends to be positively welded. In this aspect, in order for the center portion of the base part 53 to be more reliably welded, a protrusion may be formed integrally with the lower end surface (resistance welding surface) of the base part 53 at the center position.

In this embodiment, the grain size of the grains of the mounting part 51 in the vicinity of the fused part 42 is greater than the grain size of the grains thereof in the vicinity of the ground electrode 27. The "grain size of grains" refers to the average grain size of the grains in a predetermined region. As a calculation method, as described above, for example, a picture of a cross-section passing through the axis center of the precious metal tip 32 is acquired, a virtual circle with a diameter of 0.1 mm is drawn on the picture, and the number of grains included in the virtual circle is measured. In addition, by dividing the area of the virtual circle by the number of grains, a sectional area per grain is calculated, and the diameter of the grain is calculated from the area. In addition, the value obtained through the calculation is the grain size of the grains. "The vicinity of the fused part 42" is generally any region in which the distance to the fused part 42 is shorter than the distance to the ground electrode 27. For example, when a virtual circle with a diameter of 0.1 mm is to be drawn as described above, a part of the virtual circle is drawn to overlap with the fused part 42, and grains included in the circle are used for measuring the grain size. Likewise, "the vicinity of the ground electrode 27" is generally any region in which the distance to the ground electrode 27 is shorter than the distance to the fused part 42. For example, a virtual circle with a diameter of 0.1 mm is to be drawn as described above, a part of the virtual circle is drawn to overlap with the ground electrode 27, and grains included in the circle are used for measuring the grain size.

In this embodiment, in the mounting part 51, the grain size of the grains of the flange part 52 is smaller than the grain size of the grains of the protruding part 54. Particularly, when it is assumed that the grain size of the grains of the protruding part 54 is A (μm) and the grain size of the grains of the flange part 52 is B (μm), $10 < A \leqq 200$, and $0.1 \leqq B \leqq 10$ are satisfied.

The grains of the flange part 52 are fiat and oriented in a direction perpendicular to the direction (in this embodiment, the direction of the axis CL1) of the axis CL2 (see FIG. 4C) of the mounting part 51.

Here, an example of a technique for constructing the grains in each region as described above will be described with reference to FIG. 5. First, as illustrated in FIG. 5A, a fixed mold 62 having a mold surface 61 with the same shape as the outer appearance of the mounting part 51 is prepared. Then, a pedestal tip 51A which has a columnar shape and is made of a nickel alloy is placed on the mold surface 61. Here, as illustrated in FIG. 5B, it is preferable that the pedestal tip 51A has substantially the same diameter as that of the protruding part 54 and be placed and fixed to a region for forming the protruding part 54 in the mold surface 61.

Next, a movable mold 63 which is disposed at an interval from the fixed mold 62 is pressed in the arrow direction of the figure. Accordingly, a margin portion of the pedestal tip 51A or the like is moved (plastic deformed) in an upper outer periphery of the pedestal tip 51A and the space of the fixed mold 62 to form the flange part 52. The formed part is taken out of the fixed mold 62, thereby obtaining the mounting part 51 illustrated in FIG. 5C. In addition, during the forming, instead of the movable mold 63, a hammer or the like may be used as a press. By employing the forming technique, the grains of the flange part 52 are pressed and crushed, so that the grain size thereof is smaller than the grain size of the grains of the protruding part 54 which is not crushed and deformed, and the grains thereof become flat and are oriented in the direction perpendicular to the direction (the direction of the axis CIA after manufacturing) of the center axis. amended to read: For the same reason, after the manufacturing, the grain size of the grains of the base part 53 disposed on the side of the ground electrode 27 becomes smaller than the grain size of the grains of the protruding part 54 disposed on the side of the fused part 42 after the manufacturing.

Next, a method of manufacturing the spark plug 1 having the above-mentioned configuration, particularly a manufacturing process of the ground electrode 27 and the like, will be described. First, the metal shell 3 is processed in advance. That is, a through-hole is formed on a metal material (for example, an iron-based material such as S15C or S25C or a stainless material) having a columnar shape by cold forging to form a primary shape. Thereafter, a cutting process is performed to make up the outer appearance, thereby obtaining a metal shell intermediate member.

Then, an intermediate member of the ground electrode 27 is manufactured. That is, the intermediate member of the ground electrode 27 is a vertical bar-shaped member before bending. The ground electrode 27 before bending is obtained, for example, as follows.

That is, a core material made of the metal material of the inner layer 27A, and a bottomed cylindrical member made of the metal material of the outer layer 27B are prepared (neither are shown). By inserting the core material into a concave part of the bottomed cylindrical member, a cup material is thereby formed. Next, a thinning process is performed on the cup material having the two-layer structure at a cold temperature. As the thinning process performed at a cold temperature, for example, examples include wire drawing using a die or the like, extrusion using a female die, and the like. Thereafter, by performing swaging, a bar-shaped member which has a rectangular cross-section and is thinned is formed.

Subsequently, the ground electrode 27 before bending, and before tip joining, is joined to the front end surface of the metal shell intermediate member by resistance welding. In addition, since so-called "shear droop" occurs during the resistance welding, an operation for removing the "shear droop" is performed. In this example, the ground electrode 27 before bending is joined by resistance welding after performing the swaging, cutting, and the like. However, the cutting process may be performed after performing the thinning process, joining the bar-shaped member to the metal shell intermediate member, and performing the swaging. In this case, during swaging, in the state where the metal shell intermediate member is held, the bar-shaped member joined to the front end surface thereof is introduced to a processing unit (a swaging die) of a swager from the front end side. Therefore, it is not necessary to intentionally set the bar-shaped member to be long in order to guarantee a holding portion during the swaging.

Thereafter, the screw part 15 is formed at a predetermined part of the metal shell intermediate member by thread rolling. Accordingly, the metal shell 3, to which the ground electrode 27 before bending is welded, is obtained. Zinc plating or nickel plating is performed on the metal shell 3. In order to enhance corrosion resistance, chromate treatment may be additionally performed on the surface.

In the meantime, as described above, the complex 71 of the precious metal tip 32 is provided. That is, in the state where the precious metal tip 32 is in contact with the bearing surface 54*a* of the protruding part 54 of the mounting part 51, laser welding or electron beam welding is performed thereon along the outer periphery of the joining surface thereof to form the fused part 42, and accordingly the complex 71 in which the precious metal tip 32 and the mounting part 51 are strongly joined and fixed to each other is obtained.

As illustrated in FIG. 4C, the mounting part 51 (the base part 53) of the complex 71 is joined to the flat surface of the ground electrode 27 before bending by resistance welding. For more reliable welds, coating removal is performed on the weld portion before the welding, or masking is performed on a weld target portion during the plating. The welding of the complex 71 may be performed after assembling described later.

In the meantime, as well as the metal shell 3, the insulator 2 is molded. For example, a base metal granulated material is prepared by using a raw powder containing alumina as a main constituent, binder, and the like, and rubber press forming is performed using the material, thereby obtaining a cylindrical compact. Grinding is performed on the obtained compact to be shaped. Then, the shaped compact is injected into a firing furnace to be fired, thereby obtaining the insulator 2.

The center electrode 5 is prepared separately from the metal shell 3 and the insulator 2. That is, a Ni-based alloy is forged, and a copper core is provided at the center for enhancing heat dissipation. In addition, the precious metal tip 31 described above is joined by laser welding or the like to the front end portion thereof.

The center electrode 5 to which the precious metal tip 31 obtained as described above is joined and the terminal electrode 6 are sealed and fixed in the axial hole 4 of the insulator 2 with a glass seal not shown. As the glass seal, generally, borosilicate glass and metal powder are prepared and mixed to be used. In the state where the center electrode 5 is first inserted through the axial hole 4 of the insulator 2, the prepared seal member is injected into the axial hole 4 of the insulator 2, and the terminal electrode 6 is pressed from the rear side, followed being baked by firing in the firing furnace. At this timing, a glaze layer may be simultaneously fired on the surface of a shank part on the rear end side of the insulator 2, or a glaze layer may be formed in advance.

Thereafter, the insulator 2 having the center electrode 5 and the terminal electrode 6 manufactured as described above, and the metal shell 3 having the ground electrode 27 having the vertical bar shape are assembled with each other. More specifically, cold swaging or hot swaging is performed on the rear end portion of the metal shell 3 formed to be relatively thin such that parts of the insulator 2 are held surrounding the metal shell 3 in the circumferential direction.

Finally, the ground electrode 27 having the vertical bar shape is bent to adjust the spark discharge gap 33 between (the precious metal tip 31 of) the center electrode 5 and (the precious metal tip 32 of) the ground electrode 27.

With this series of processes, the spark plug 1 having the above-mentioned configuration is manufactured.

As described above, in this embodiment, the mounting part 51 protrudes from the ground electrode 27 and is more likely to be exposed to high temperature. There is a concern that an oxide film will be formed by a combination of material that is more likely to oxidize and oxygen at the interface (see reference numeral KM shown as a thick line in FIG. 3) between the fused part 42 and the mounting part 51. In this aspect, in this embodiment, the grain size of the grains of the mounting part 51 in the vicinity of the fused part 42 is greater than the grain size of the grains thereof in the vicinity of the ground electrode 27. Accordingly, in the mounting part 51 in the vicinity of the fused part 42, (the number of) pathways on which a material that is more likely to oxidize can move to the interface KM is relatively small. Therefore, even when oxygen intrudes into the interface KM, the material that is more likely to oxidize hardly appears at the interface KM from the inside of the mounting part 51, so that formation of an oxide film rarely occurs. As a result, the stable joining strength at the interface KM can be guaranteed for a long time, thereby preventing degradation in the exfoliation resistance of the precious metal tip 32 for the ground electrode.

On the side of the mounting part 51 joined to the ground electrode 27, the base part 53 having the flange part 52 is provided. Accordingly, it is possible to achieve an increase in joining area and a stronger junction. Since the heat transfer path of the precious metal tip 32 is widened, it is possible to achieve an improvement in the durability of the precious metal tip 32.

In the mounting part 51, the grain size of the grains of the flange part 52 is smaller than the grain size of the grains of the protruding part 54. Accordingly, even when a spark discharge occurs between the precious metal tip 31 for the center electrode, and the flange part 52, the grain separation is relatively small, so that damage due to the separation can be minimized.

Particularly, since the grain size A of the grains of the protruding part 54 is greater than 10 μm, significant improvement in oxidation resistance can be achieved, so that it is possible to further prevent the degradation in exfoliation resistance of the precious metal tip 32. Since the grain size A of the grains of the protruding part 54 is smaller than 200 μm, a situation where the precious metal tip 32 is separated as the grains are separated rarely occurs.

On the other hand, since the grain size B of the grains of the flange part 52 is equal to or smaller than 10 μm, it is possible to prevent an increase in a degree of the flange part 52 consumed as the relatively larger grains are separated. In addition, since the grain size B of the grains of the flange part 52 is equal to or greater than 0.1 it is possible to prevent degradation in processability.

In this embodiment, since the grains of the flange part 52 are flat and oriented in the direction perpendicular to the direction of the axis CIA, although a spark discharge toward the flange part 52 as described above and the grains are separated, it is possible to minimize recesses and cracks formed in the direction of the axis (the thickness direction). As a result, it is possible to prevent spark consumption resistance degradation in the mounting part 51.

Here, in order to check the advantages, various samples were manufactured for various types of evaluation. The experiment results are described as follows.

First, as first samples, samples which have an average grain size of 5 μm for the grains of the mounting part in the vicinity (the flange part) of the ground electrode, and different average grain sizes for the grains in the vicinity (that is, in the vicinity of the fused part: protruding part) of the precious metal tip (Pt-10Ni) were prepared, and an oxidation resistance test was performed on each of the samples. As the test condition of the oxidation resistance test, a cycle for heating for two minutes at 950° C. and cooling for one minute is referred to as one cycle, and the test is performed for 1000 cycles. After 1000 cycles, a cross-section (a cross-section passing through the axis of the precious metal tip) of the weld interface between the fused part and the mounting part is observed to measure the ratio of an oxide film existing at the weld interface. The ratio of the oxide film is a value represented as a percent, which is obtained by performing component analysis on the weld interface (corresponding to the KM in FIG. 3) and dividing the total length of the weld interface by the total length of the region where the oxide is formed. The result is shown in FIG. 6.

As shown in the figure, in the case where the average grain size of the grains of the mounting part in the vicinity (the protruding part) of the fused part is greater than the average grain size of the grains of the mounting part in the vicinity of the ground electrode, it becomes apparent that the ratio of the oxide film is equal to or less than 20% and the oxide film is hardly formed. On the contrary, in the case where the average grain size of the grains in the vicinity (protruding part) of the fused part is smaller than the average grain size of the grains in the vicinity (the flange part) of the ground electrode, the ratio of the oxide film is significantly high. It is thought that this is because (the number of pathways on which material that is more likely to oxidize can move toward the interface between the mounting part and the fused part increases in the mounting part in the vicinity (the protruding part) of the fused part, and when oxygen intrudes into the interface, a relatively large amount of the material that is more likely to oxidize appears at the interface from the inside of the mounting part to form an oxide film.

In FIG. 6, in the case where the average grain size of the grains in the protruding part is greater than 10 μm, it becomes apparent that the ratio of the oxide film is equal to or less than 20%, and an oxide film is hardly formed. On the other hand, the average size of the grains in the protruding part is smaller than 10 μm (for example, equal to or smaller than 8 μm), the ratio of the oxide film has a significantly high value. Although not shown in FIG. 6, it could be seen that in the case where the average grain size of the grains in the protruding part is 200 μm, a missing part that occurs when the grains are separated is large, and there is an apparent difficulty in joining the precious metal tip.

Next, samples which have an average grain size 15 μm for the grains of the mounting part in the vicinity (the protruding part) of the fused part and different average grain sizes for the grains in the flange part were prepared, and a desk spark endurance text was performed on each of the samples. That is, in the desk spark endurance text, a test for generating 100 spark discharges per second under a nitrogen gas atmosphere for 250 hours was performed to measure the amount (the length of the flange part consumed in the direction of the axis) of the flange part consumed before and after the test. The result is shown in FIG. 7.

As shown in the figure, in the case where the average grain size of the grains in the flange part is smaller than the average grain size of the grains of the mounting part in the vicinity (the protruding part) of the fused part, it is possible to prevent the consumption of the flange part. On the contrary, in the case where the average grain size of the grains in the flange part is greater than the average grain size of the grains in the vicinity (the protruding part) of the fused part, it becomes apparent that the consumption degree of the flange part increases. It is thought that this is because there is a possibility that the grains of the flange part of the mounting part are separated at every grain boundary due to the impact of the spark discharge, and when the grains are large, the degree of consumption due to the separation increases.

In addition, in FIG. 7, it becomes apparent that in the case where the average grain size of the grains in the flange part is equal to or smaller than μm, the degree of consumption can be prevented to be equal to or less than 0.01 mm. On the contrary, in the case where the average grain size of the grains in the flange part is greater than 10 μm (for example, in the case of being equal to or greater than 12 μm), the degree of consumption of the flange part significantly increases. In addition, although not shown in FIG. 7, in the case where the average grain size of the grains in a region corresponding to the flange part is 0.1 μm, forming the mounting part becomes difficult.

In addition, it is not limited to the embodiment described above, and may be embodied, for example, as follows.

(a) In the embodiment, the mounting part 51 has the base part 53 which has a disc shape and is provided with the flange part on the outer periphery, and the protruding part 54 which has a columnar shape protruding from the base part 53 to employ a convex shape in a cross-section. However, in an embodiment of the first configuration, a mounting part having another shape may be employed. For example, a pedestal having a simple columnar shape may be employed.

(b) In the embodiment, the case where the outer layer 27B exists between the inner layer 27A and the mounting part 51 is specified. However, a case where the outer layer 27B is not interposed may be specified. In this case, the mounting part 51 comes in contact with the inner layer 27A, and the distance between the inner layer 27A and the precious metal tip 32 can be reduced, thereby achieving an improvement in heat transfer.

(c) In the embodiment, a cross-section in which one side and the other side of the fused part 42 are not connected to each other is shown, however, they may be connected to each other.

(d) In the embodiment, the front end surface of the precious metal tip 31 for the center electrode is opposed to the inner surface of the front end portion of the precious metal tip 32 for the ground electrode, however, as illustrated in FIG. 8, for example, a type (a so-called transverse discharge type) in which the complex 71 is joined to a front end surface 27*s* of the ground electrode 27 and the front end surface of the precious metal tip 32 for the ground electrode is opposed to the center electrode 5 or a side peripheral surface of the precious metal tip 31 for the center electrode may be employed.

(e) In this embodiment, the case where the ground electrode 27 is joined to the front end surface of the front end portion 26 of the metal shell 3 is specified, however, a case where a part (a part of a front end metal component that is welded to the metal shell in advance) of the metal shell is cut off to form the ground electrode may be applied (for example, JP-A-2006-286906 and the like). In addition, the ground electrode 27 may be joined to the side surface of the front end portion 26 of the metal shell 8.

DESCRIPTION OF REFERENCE NUMERALS AND SIGNS

Figure 1:
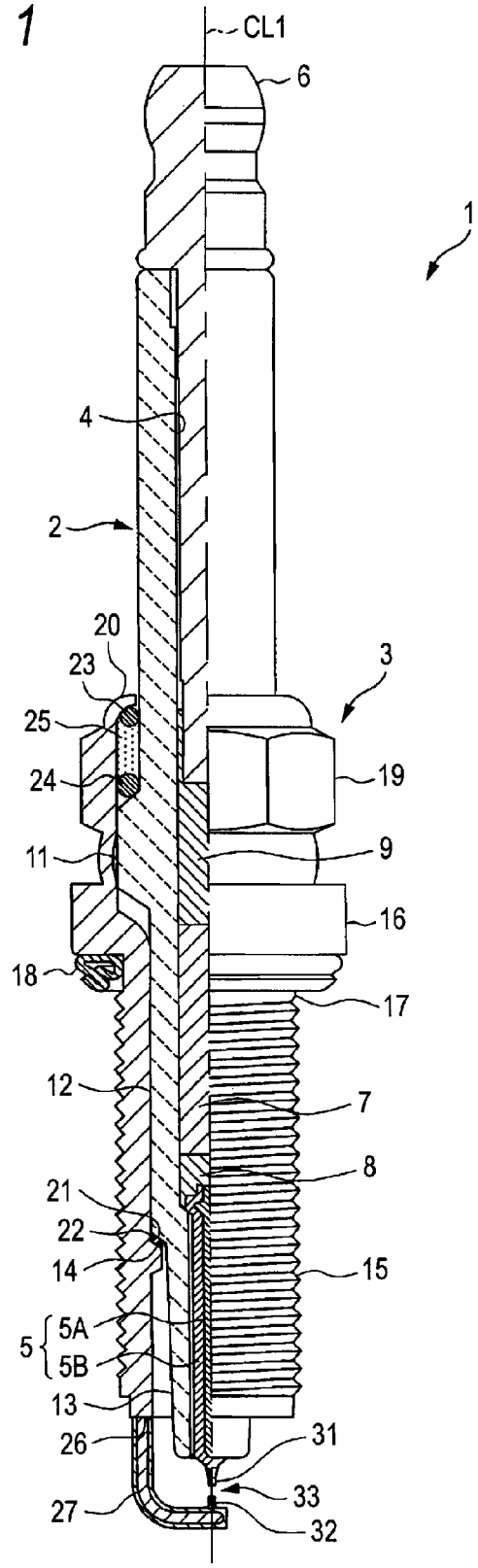
FIG. 1 is a partially cutaway front view illustrating the configuration of a spark plug according to an embodiment.
Figure 2:
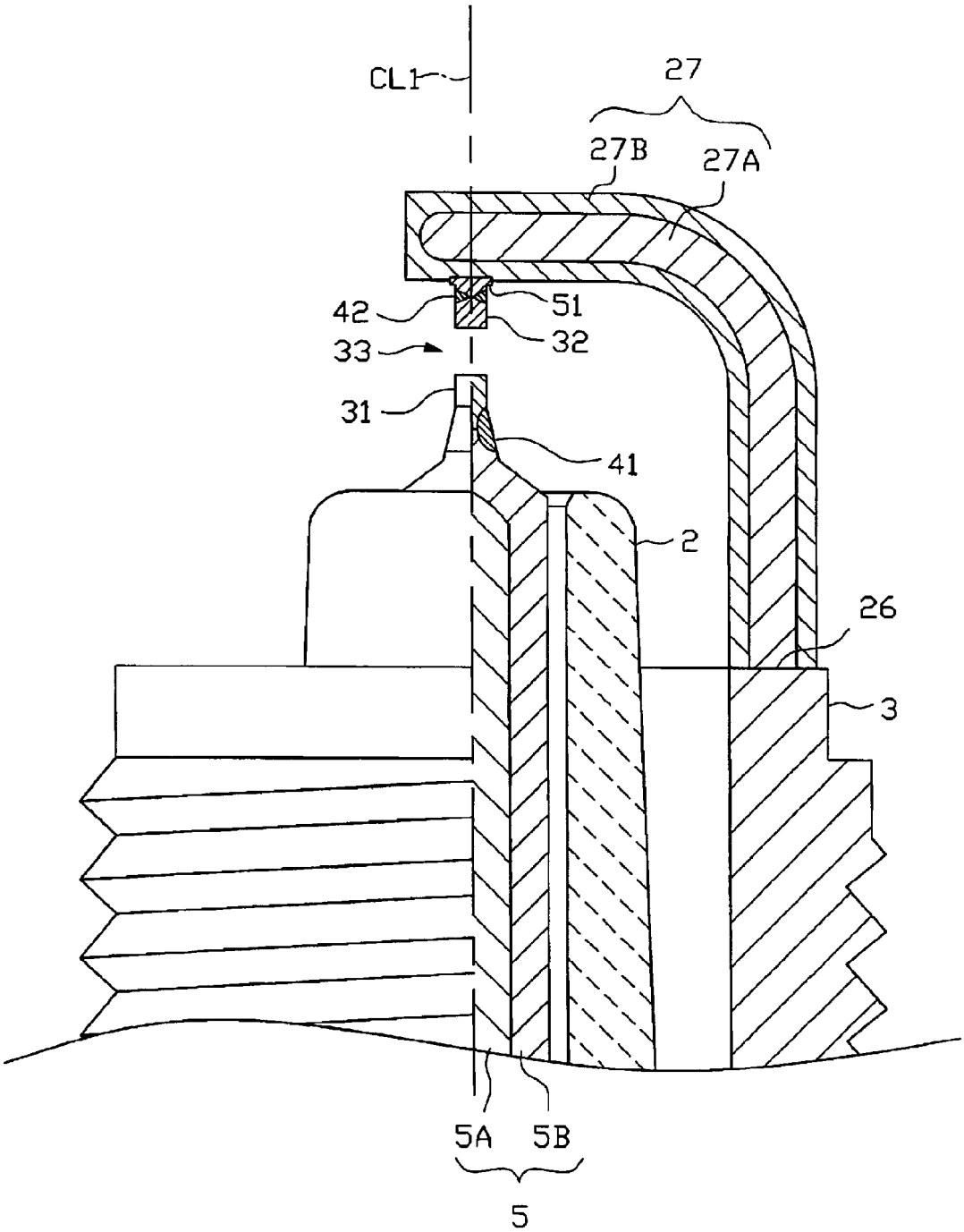
FIG. 2 is a partially enlarged sectional view of the spark plug.
Figure 3:
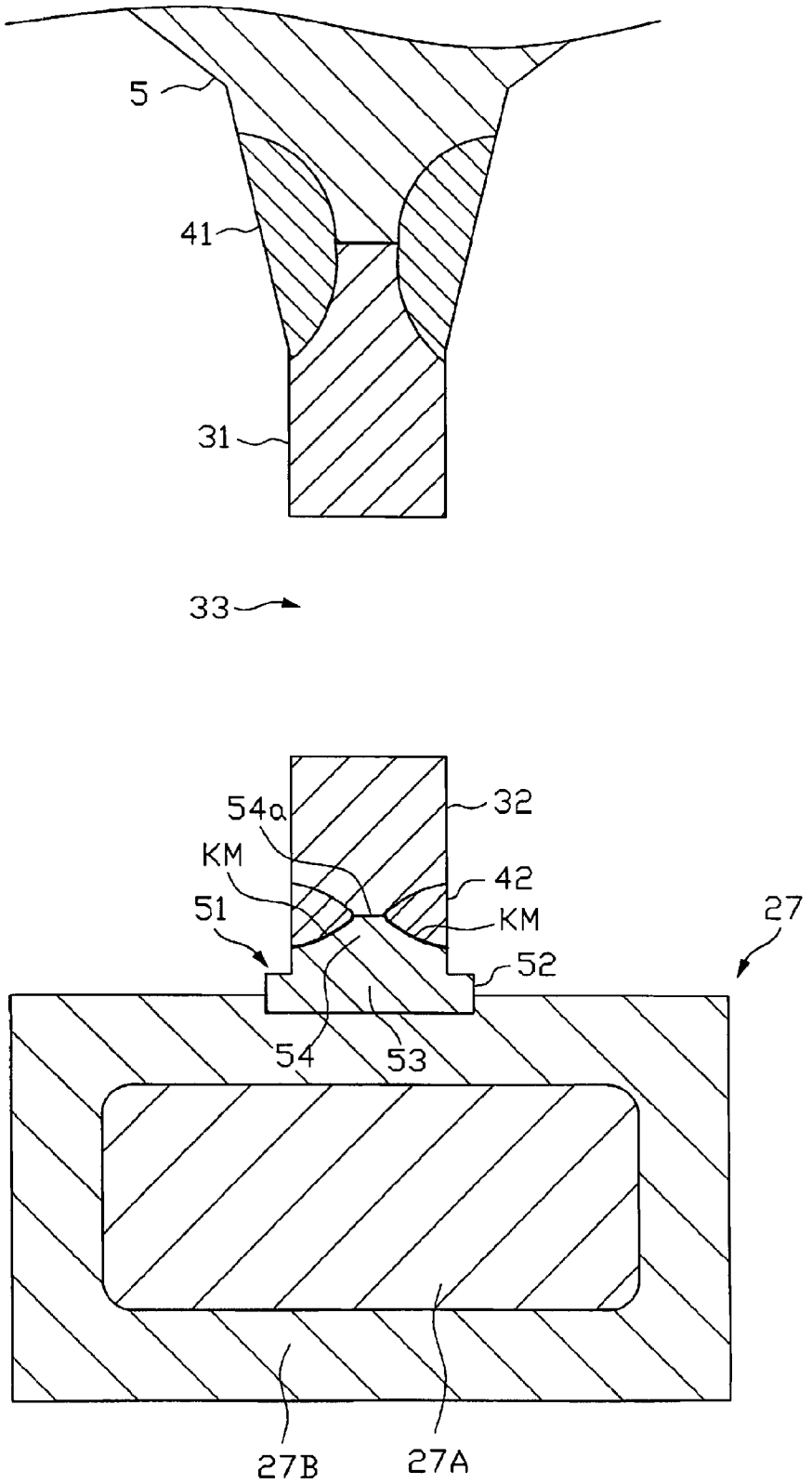
FIG. 3 is an enlarged sectional view illustrating the spark plug as viewed from the direction perpendicular to FIG. 2.
Figure 4A:
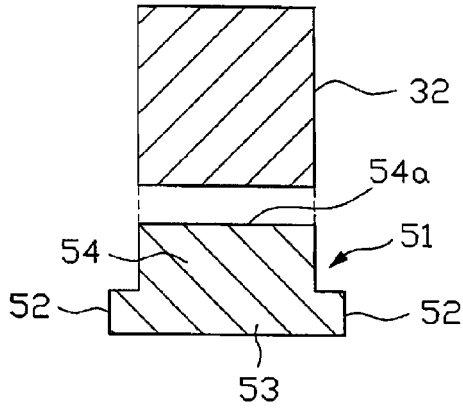
FIGS. 4A to 4C are sectional views schematically illustrating a manufacturing process of a complex and a ground electrode.
Figure 4B:
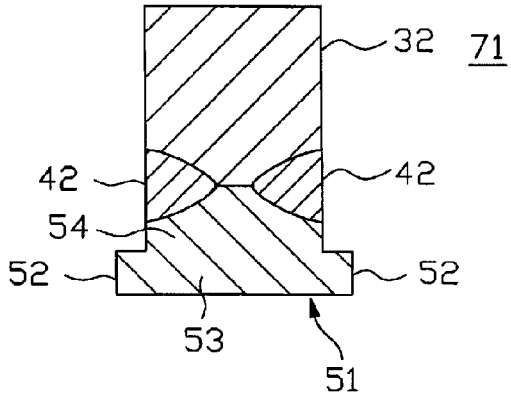
Figure 4C:
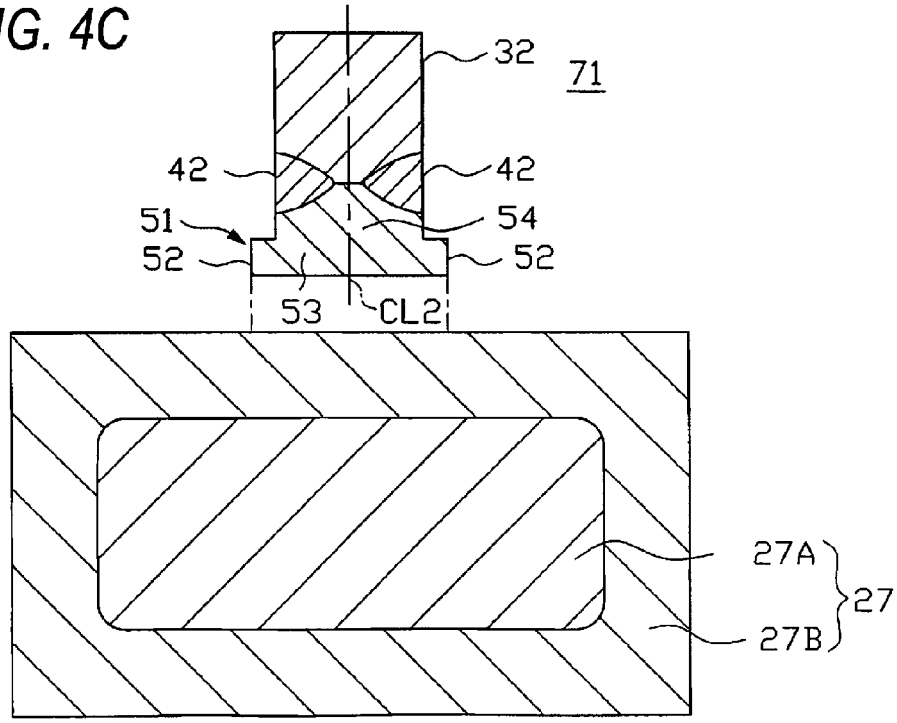
Figure 5A:
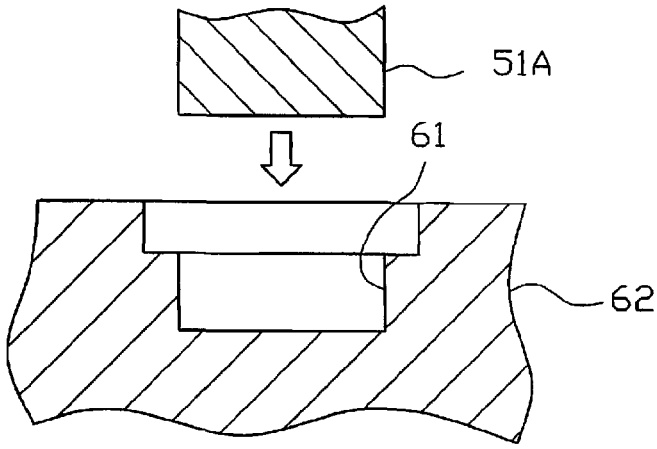
FIGS. 5A to 5C are sectional views schematically illustrating a manufacturing process of a mounting part.
Figure 5B:
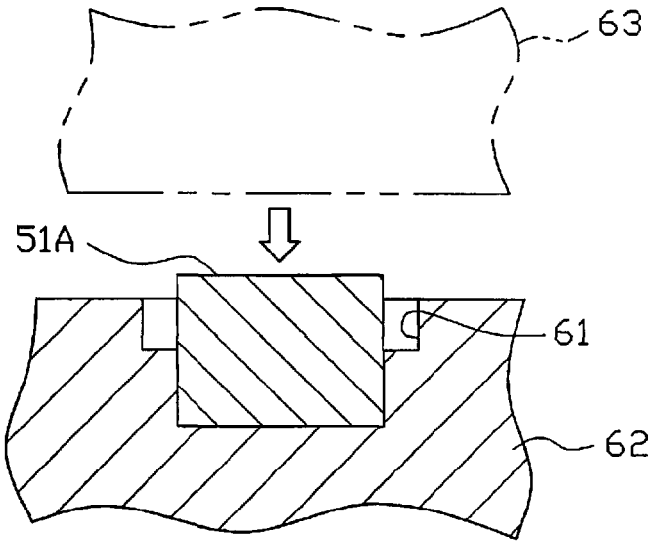
Figure 5C:
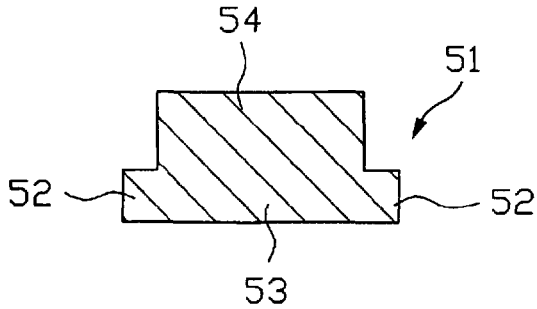
Figure 6:
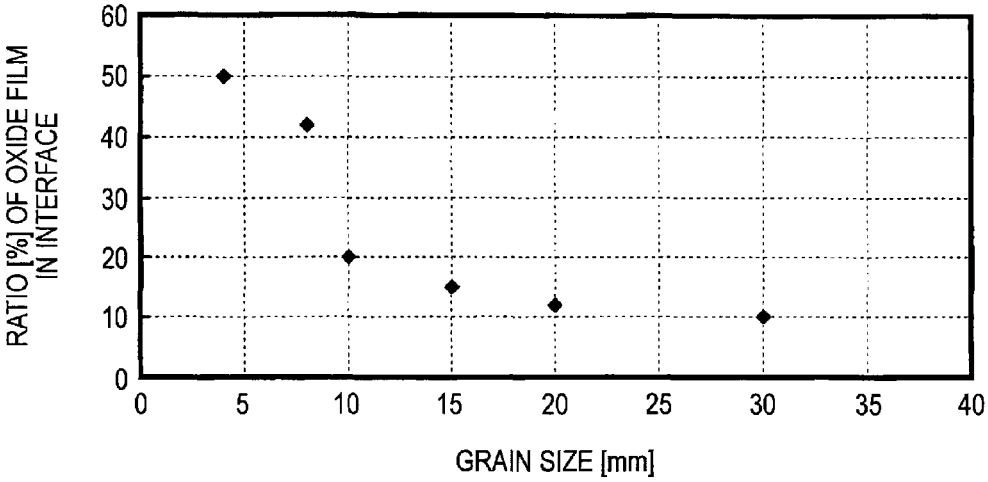
FIG. 6 is a graph showing a relationship of a formation ratio of an oxide film in the case where the average grain size of grains of the mounting part in the vicinity of the ground electrode is uniform and the average grain size of grains in the vicinity of a fused part is changed.
Figure 7:
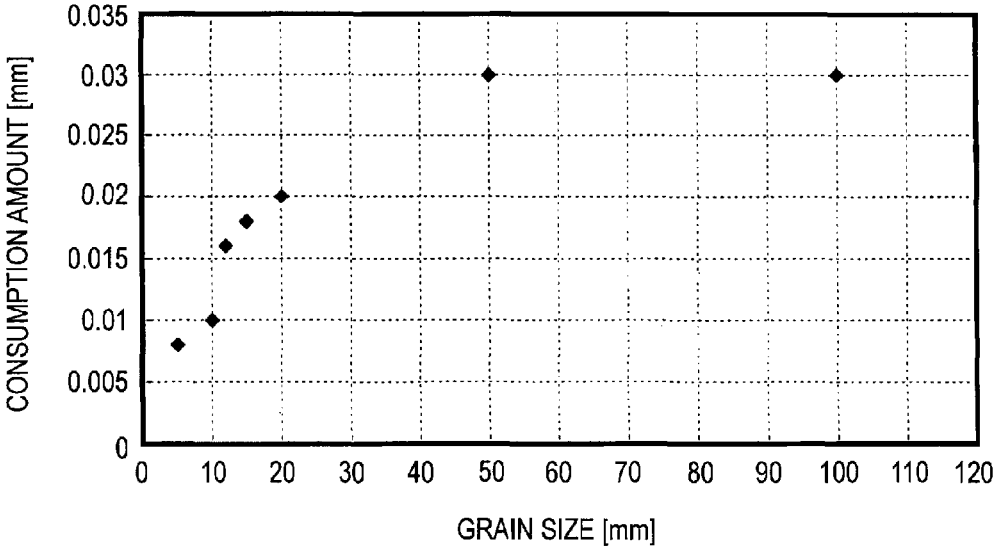
FIG. 7 is a graph showing a relationship of the amount of the flange part consumed in the case where the average grain size of the grains of the mounting part in the vicinity of the fused part is uniform and the average grain size of the grains in the flange part is changed.
Figure 8:
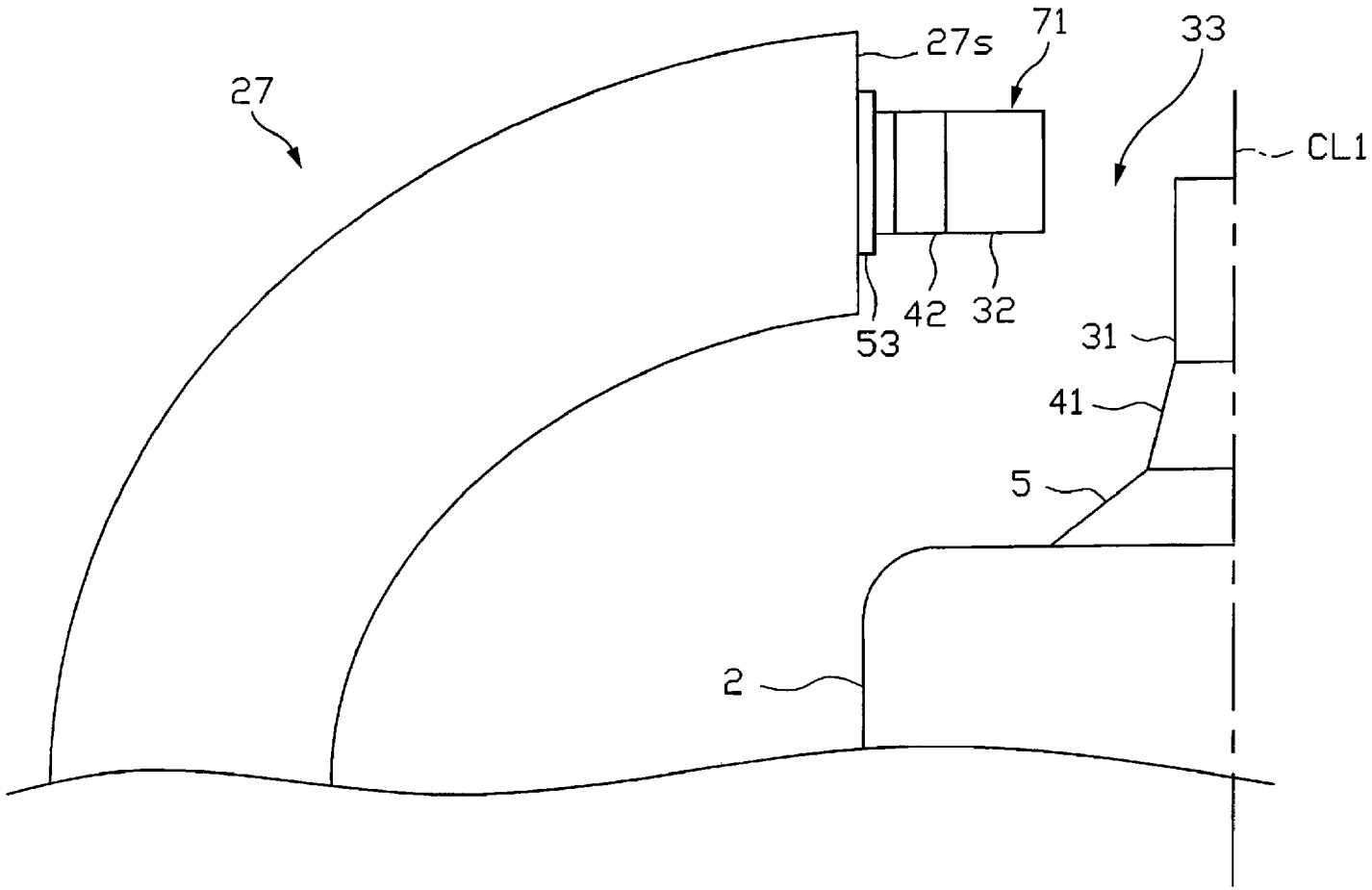
FIG. 8 is a partially enlarged view of a spark plug according to another embodiment.

1: SPARK PLUG
2: INSULATOR
3: METAL SHELL
5: CENTER ELECTRODE
27: GROUND ELECTRODE
31: PRECIOUS METAL TIP (FOR CENTER ELECTRODE)
32: PRECIOUS METAL TIP (FOR GROUND ELECTRODE)
33: SPARK DISCHARGE GAP
42: FUSED PART
51: MOUNTING PART
52: FLANGE PART
53: BASE PART
54: PROTRUDING PART
54*a*: BEARING SURFACE
71: COMPLEX
CL1: AXIS
CL2: AXIS (OF MOUNTING PART)

The invention claimed is:

1. A spark plug for an internal combustion engine comprising:

a center electrode which has a bar shape extending in the direction of an axis;

an insulator which has a substantially cylindrical shape and is provided on the outer periphery of a center electrode;

a tubular metal shell which is provided on the outer periphery of the insulator; and a metal ground electrode which has a base end portion joined to the metal shell and a front end portion disposed to face a front end portion of the center electrode, wherein a ground electrode precious metal tip is joined to the front end portion of the ground electrode at a position opposed to the front end portion of the center electrode or a center electrode precious metal tip joined to the front end of the center electrode, wherein a spark discharge gap is formed between the front end portion of the center electrode or the front end portion of the center electrode precious metal tip, and the front end portion of the ground electrode precious metal tip, wherein the ground electrode precious metal tip is joined to a bearing surface of a mounting part containing the same metal as the ground electrode with a fused part formed by performing laser welding or electron beam welding on the metal of the two to be fused together, wherein the mounting part is joined to the ground electrode, and wherein grain size of the grains of the mounting part in the vicinity of the fused part is greater than the grain size of the grains thereof in the vicinity of the ground electrode.

2. The spark plug according to claim 1, wherein the mounting part includes:

a disc shape base part having one end surface which is joined to the ground electrode; and a protruding part which protrudes from the other end surface of the base part and has a columnar shape with a smaller diameter than that of the base part, and to which the ground electrode precious metal tip is joined, a part of the base part which protrudes in the outer peripheral direction from the protruding part is a flange part, and the grain size of the grains of the flange part is smaller than the grain size of the grains of the protruding part.

3. The spark plug according to claim 2, wherein, $A>10$, and $B\leqq 10$ are satisfied, where A (μm) represents the grain size of the grains of the protruding part and B (μm) represents the grain size of the grains of the flange part.

4. The spark plug according to claim 3, wherein, $10<A\leqq 200$, and $0.1\leqq B\leqq 10$ are satisfied.

5. The spark plug according to claim 2, wherein the grains of the flange part are flat and oriented in a direction perpendicular to the direction of the axis of the mounting part.

6. The spark plug according to claim 1, wherein the mounting part contains metal that is the same as the main component of the ground electrode.

7. A spark plug for an internal combustion engine comprising:

a center electrode which has a bar shape extending in the direction of an axis;

an insulator which has a substantially cylindrical shape and is provided on the outer periphery of a center electrode;

a tubular metal shell which is provided on the outer periphery of the insulator; and a metal ground electrode which has a base end portion joined to the metal shell and a front end portion disposed to face a front end portion of the center electrode, wherein a ground electrode precious metal tip is joined to the front end portion of the ground electrode at a position opposed to the front end portion of the center electrode or a center electrode precious metal tip joined to the front end of the center electrode, wherein a spark discharge gap is formed between the front end portion of the center electrode or the front end portion of the center electrode precious metal tip, and the front end portion of the ground electrode precious metal tip, wherein the ground electrode precious metal tip is joined to a bearing surface of a mounting part containing the same metal as the ground electrode with a fused part formed by performing laser welding or electron beam welding on the metal of the two to be fused together, wherein the mounting part is joined to the ground electrode, wherein the mounting part includes:

a disc shape base part having one end surface which is joined to the ground electrode;

a protruding part which protrudes from the other end surface of the base part and has a columnar shape with a smaller diameter than that of the base part, and to which a ground electrode precious metal tip is joined; and a part of the base part which protrudes in the outer peripheral direction from the protruding part is a flange part, and wherein grain size of the grains of the flange part is smaller than the grain size of the grains of the protruding part.

8. The spark plug according to claim 7, wherein, $A>10$, and $B\leqq 10$ are satisfied, where A (μm) represents the grain size of the grains of the protruding part and B (μm) represents the grain size of the grains of the flange part.

9. The spark plug according to claim 8, wherein, $10<A\leqq 200$, and $0.1\leqq B\leqq 10$ are satisfied.

10. The spark plug according to claim 7, wherein the grains of the flange part are flat and oriented in a direction perpendicular to the direction of the axis of the mounting part.

11. The spark plug according to claim 7, wherein the mounting part contains metal that is the same as the main component of the ground electrode.

* * * * *